US008887686B2

(12) United States Patent
Nutter

(10) Patent No.: US 8,887,686 B2
(45) Date of Patent: Nov. 18, 2014

(54) FLEXIBLE COMPUTER CONTROL FOR AN INTERNAL COMBUSTION ENGINE WITH HEMISPHERICAL COMBUSTION CHAMBERS

(71) Applicant: Arthur C. Nutter, Vancouver, WA (US)

(72) Inventor: Arthur C. Nutter, Vancouver, WA (US)

( * ) Notice: Subject to any disclaimer, the term of this patent is extended or adjusted under 35 U.S.C. 154(b) by 262 days.

(21) Appl. No.: 13/676,847

(22) Filed: Nov. 14, 2012

(65) Prior Publication Data

US 2013/0118001 A1 May 16, 2013

Related U.S. Application Data

(60) Provisional application No. 61/559,187, filed on Nov. 14, 2011.

(51) Int. Cl.

| | |
|---|---|
| ***F02B 19/04*** | (2006.01) |
| ***F02B 1/12*** | (2006.01) |
| ***F02D 45/00*** | (2006.01) |
| ***F02D 11/10*** | (2006.01) |
| ***F02B 77/08*** | (2006.01) |
| *F01L 13/00* | (2006.01) |

(52) U.S. Cl.

CPC ..... *F02D 45/00* (2013.01); *F02D 11/106* (2013.01); *F02B 77/083* (2013.01); *F02B 77/084* (2013.01); *F02B 77/085* (2013.01); *F02D 2400/11* (2013.01); *F02D 2400/22* (2013.01); *F02D 2400/00* (2013.01); *F01L 2013/001* (2013.01); *F01L 2250/02* (2013.01); *F01L 2820/031* (2013.01); *F01L 2820/041* (2013.01)

USPC ..... 123/193.5; 123/193.2; 123/192.1

(58) Field of Classification Search

USPC ..... 29/592.1, 593–595, 426.6, 825, 854; 73/23.31–23.32; 123/685–689, 123/677–682, 361, 399, 192.1–192.4, 123/193.2, 196, 197.1–197.4; 74/512–513, 74/579 R; 701/108–109, 22

See application file for complete search history.

(56) References Cited

U.S. PATENT DOCUMENTS

| | | | | |
|---|---|---|---|---|
| 6,733,418 | B2 * | 5/2004 | Tachibana et al. | 477/125 |
| 6,802,113 | B2 * | 10/2004 | Staker | 29/595 |
| 7,104,240 | B1 * | 9/2006 | Vuk et al. | 123/193.2 |
| 8,468,997 | B2 * | 6/2013 | Wilkins | 123/197.3 |
| 8,584,649 | B2 * | 11/2013 | Watanabe | 123/399 |
| 8,741,118 | B2 * | 6/2014 | Inagaki | 204/406 |
| 8,820,297 | B2 * | 9/2014 | Iwatani | 123/348 |
| 2013/0118001 | A1 * | 5/2013 | Nutter | 29/593 |

* cited by examiner

*Primary Examiner* — Minh Trinh

(57) ABSTRACT

A method of installing a flexible computer control for an internal combustion engine with a plurality of hemispherical combustion chambers includes an engine control unit (ECU), a plurality of sensors, and related components. Main harness of the ECU, which is electrically pre-connected with the ECU, electrically connected with the plurality of sensors and the related components so that data can be retrieved and sent. The data sent by the ECU enables an individual to perform modification of the internal combustion engine with a plurality of hemispherical combustion chambers.

13 Claims, 18 Drawing Sheets

FLEXIBLE COMPUTER CONTROL FOR AN INTERNAL COMBUSTION ENGINE WITH HEMISPHERICAL COMBUSTION CHAMBERS

The current application claims a priority to the U.S. Provisional Patent application Ser. No. 61/559,187 filed on Nov. 14, 2011.

FIELD OF THE INVENTION

The present invention relates generally to a system to computerize control of an engine. More particularly, to a method which enables the user to customize gasoline-fueled internal combustion engine with a plurality of hemispherical combustion chambers.

BACKGROUND OF THE INVENTION

The first internal combustion engine with a plurality of hemispherical combustion chambers appeared on the market in 1951. Since then, the internal combustion engines with a plurality of hemispherical combustion chambers have been used extensively in the custom car field, being modified and swapped into countless custom vehicles, and in racing form, achieving dominance in several forms of motor racing.

The current version, third generation, internal combustion engine with a plurality of hemispherical combustion chambers is first appeared on the market in year 2003, in the 5.7 liter version. Since that time, 6.1 liter and 6.4 liter internal combustion engines with a plurality of hemispherical combustion chambers have been produced. The fuel delivery and spark delivery systems on the current version of the internal combustion engines with a plurality of hemispherical combustion chambers, like all current automotive engines, is controlled by a dedicated purpose computer, known as an engine control unit, or ECU.

The current version of the internal combustion engines with a plurality of hemispherical combustion chambers (2003 and newer), although it incorporates new and advanced engine technology, have not become popular in the custom automobile field, largely due to the difficulties in adapting the existing ECU to other applications, more specifically in regard to the difficulties encountered in reprogramming the existing ECU to correctly manage the engine after any performance-improving engine modifications have been made.

In contrast, other engines have seen wide acceptance and usage in that field, due in part to the ease with which original ECU can be adapted and reprogrammed. In addition, the other engine's control technology is substantially advanced over the technology of the internal combustion engine with a plurality of hemispherical combustion chambers. The other engine technology is based on the measurement of the instantaneous mass flow rate of the air being ingested for combustion, whereas the internal combustion engine with a plurality of hemispherical combustion chambers uses measured air density and throttle position to make a guess at the mass airflow rate.

The latent demand for the different uses of the internal combustion engine with a plurality of hemispherical combustion chambers for swaps and customized vehicles is apparent. Thus, an impediment to such usage created by the difficulties with the existing ECU.

Further, if a custom car builder wants to use the internal combustion engines with a plurality of hemispherical combustion chambers with a current-technology electronically-controlled transmission, the builder has only one option, which is to retain the compatible transmission and ECU, which limit the custom car builder to a completely un-modifiable engine package.

It is therefore an object of the present invention to introduce a methodology and hardware system which enables a user to replace the existing ECU and associated components of the internal combustion engines with a plurality of hemispherical combustion chambers with a separate ECU, supporting hardware and electronics, allowing comprehensive performance improvements to the internal combustion engines with a plurality of hemispherical combustion chambers, while retaining all the immense drivability.

DETAIL DESCRIPTIONS OF THE INVENTION

Figure 1:
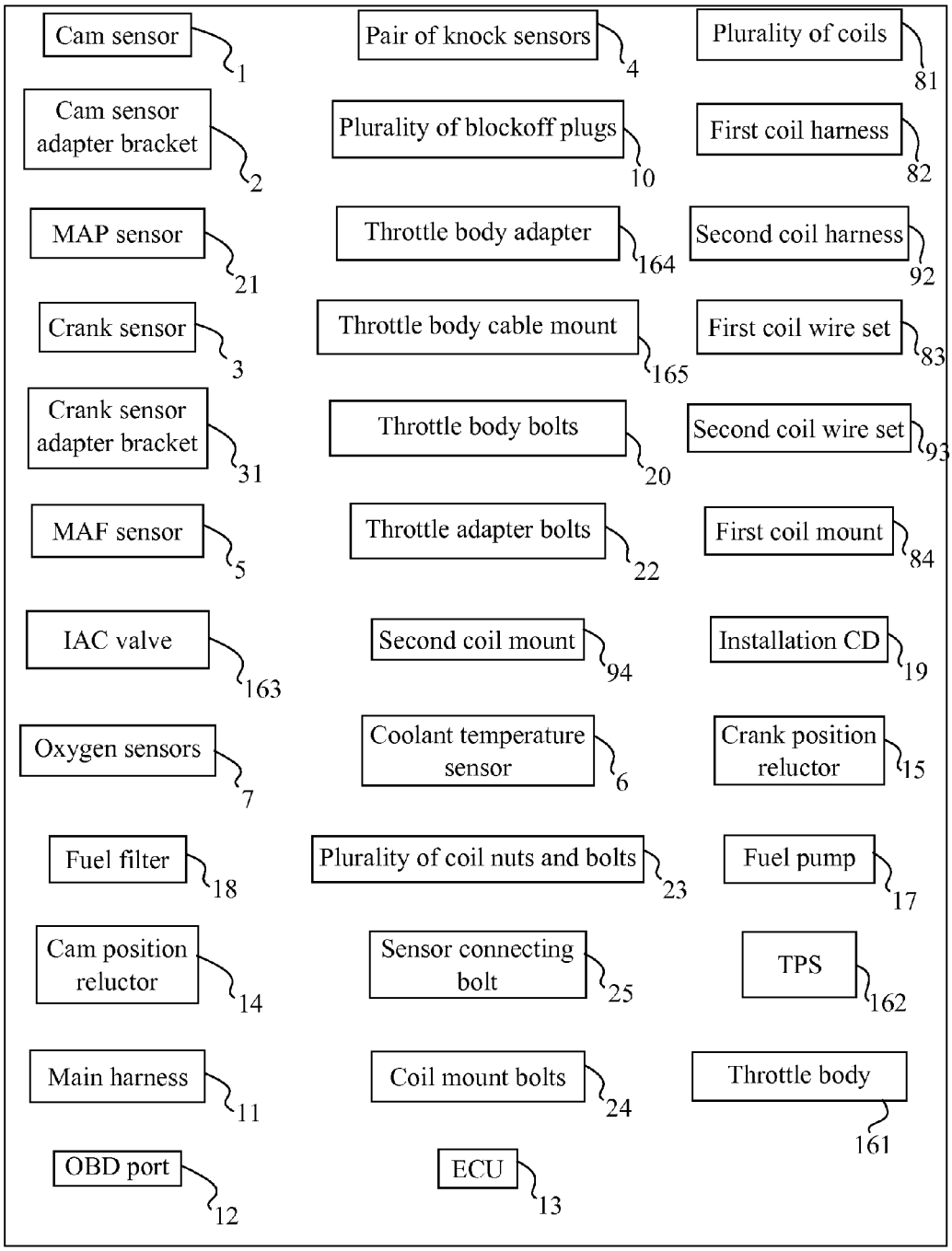
FIG. 1 is illustrating the schematic view of all the components in the present invention.
Figure 2:
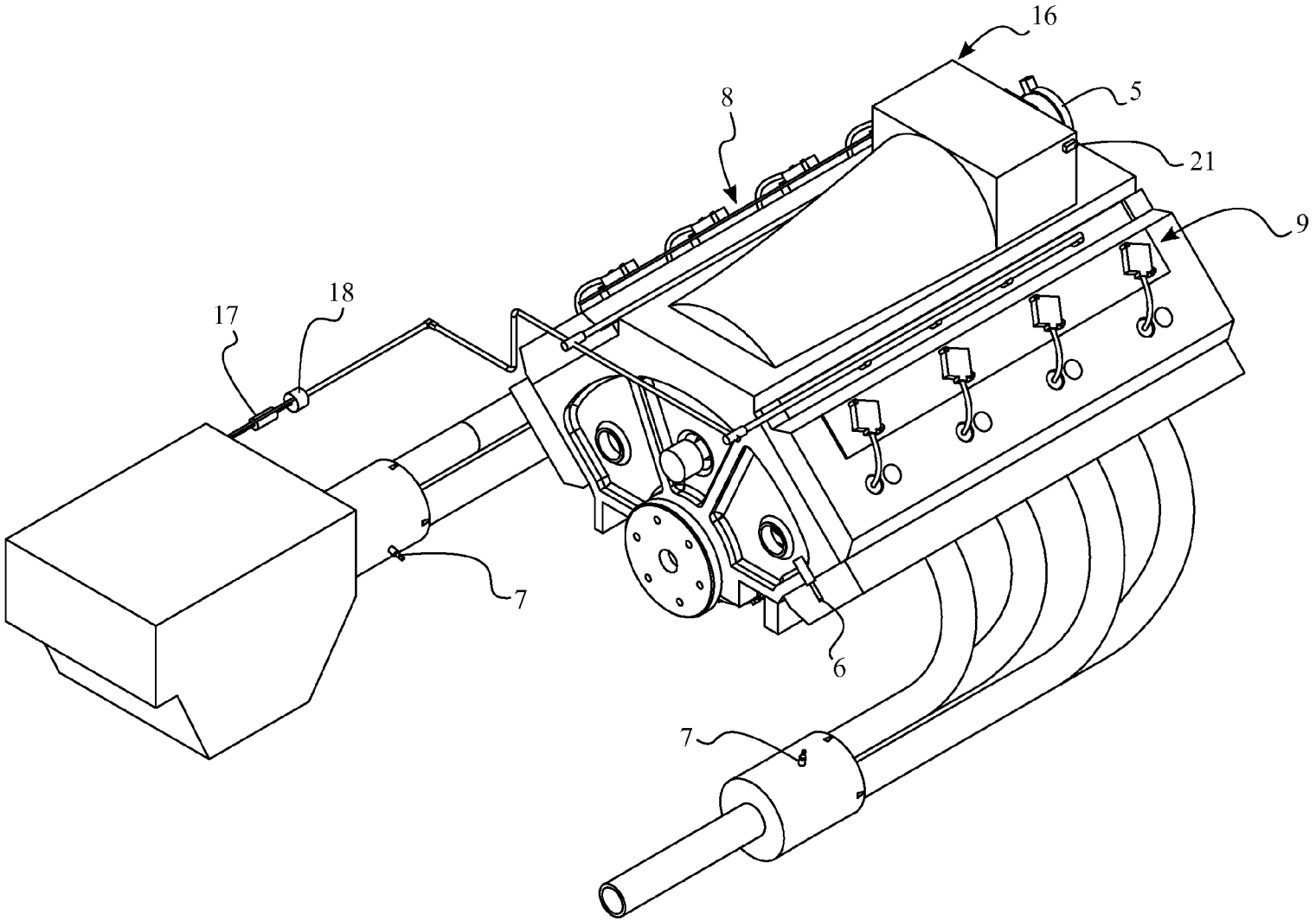
FIG. 2 is a perspective view of an engine illustrating the location of some of the components in the present invention.

All illustrations of the drawings are for the purpose of describing selected versions of the present invention and are not intended to limit the scope of the present invention.

The present invention is a retrofitting kit with a flexible computer control system which improves the standard horsepower of an internal combustion engine with a plurality of hemispherical combustion chambers. The internal combustion engine with a plurality of hemispherical combustion chambers is different from other internal combustion engines mainly due to hemispherical shaped combustion chambers where the hemispherical shaped combustion chambers provides lower heat escape and higher peak pressure. The internal combustion engine with a plurality of hemispherical combustion chambers is herein after described as the hemispherical internal combustion engine. The present invention provides a low cost and efficient method where the installing method can be carried out by any individual who has a basic knowledge about the internal combustion engines. In reference to FIG. 1, FIG. 2, FIG. 3, FIG. 4, FIG. 5, FIG. 6, and FIG. 9, the present invention comprises a cam sensor 1, a cam sensor adapter bracket 2, a manifold absolute pressure (MAP) sensor 21, a crank sensor 3, a crank sensor adapter bracket 31, a pair of knock sensors 4, A mass airflow (MAF) sensor 5, a coolant temperature sensor 6, oxygen sensors 7, a first coil pack 8, a second coil pack 9, a plurality of blockoff plugs 10, a main harness 11, an engine control unit (ECU) 13, a cam position reluctor 14, a crank position reluctor 15, a throttle mechanism 16, a fuel pump 17, a fuel filter 18, and an installation CD 19.

The installation CD 19 provides step by step installation instructions for the present invention so that the individual can properly install the present invention to the hemispherical internal combustion engine. The hemispherical internal combustion engine is completed with a crankshaft, a camshaft, a cam sprocket, a crank sprocket, a timing chain, an intake manifold, an engine block, rocker covers, a cold air intake, a plurality of fuel injectors, a plurality of spark plugs, exhaust headers, and many other related engine components which are required for the functionality of the hemispherical internal combustion engine.

Figure 10:
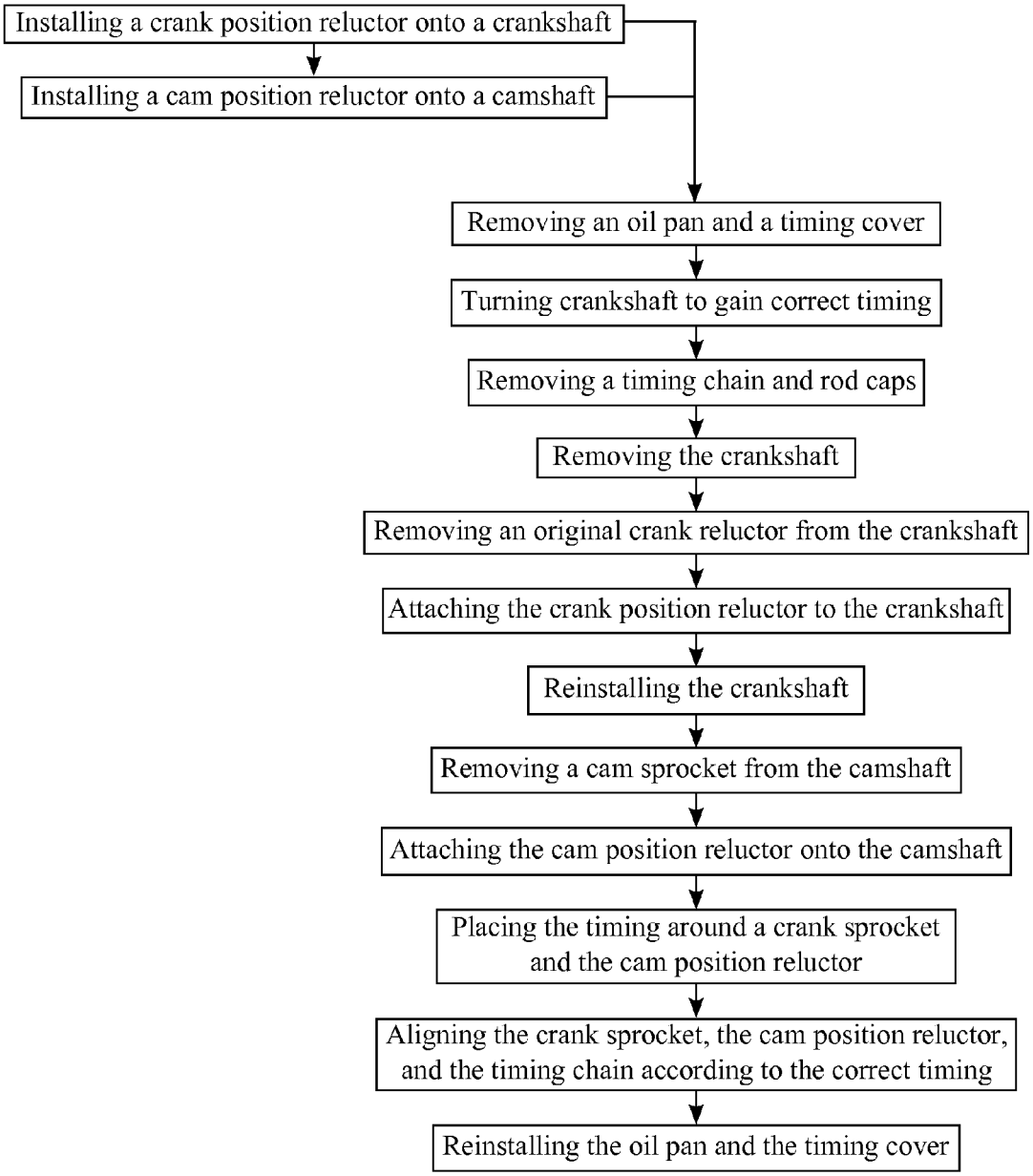
FIG. 10 is a simplified flow chart illustrating the method of installing a crank position reluctor and a cam position reluctor.

In reference to FIG. 10, an oil pan and a timing chain cover of the engine block are removed from the engine block as the initial steps. A sharpened putty knife or a screwdriver may be used to separate the oil pan from the engine block, if the oil pan does not separate easily from the engine block. Then the crankshaft is turned so that correct timing can be achieved for the crank sprocket, the cam sprocket, and the timing chain. Then the timing chain is removed from the crank sprocket and the cam sprocket. Rod caps are then removed from the engine block where the rod caps are positioned around the crankshaft. The crankshaft is then carefully removed from the engine block so that an original crank reluctor, which is also known as toothwheel and tone ring, can be detached from the crankshaft. Since the original crank reluctor is attached with a plurality of toothwheel bolts with strong threadlocker, the plurality of toothwheel bolts can be loosen by carefully heating them with a propane torch. During the process of loosening the plurality of toothwheel bolts, it is important to monitor the surface temperature with a non-contact infrared digital thermometer so that the temperature don't get over 250 degrees of Fahrenheit. A high-quality bit socket is used to remove the plurality of toothwheel bolts.

Figure 7:
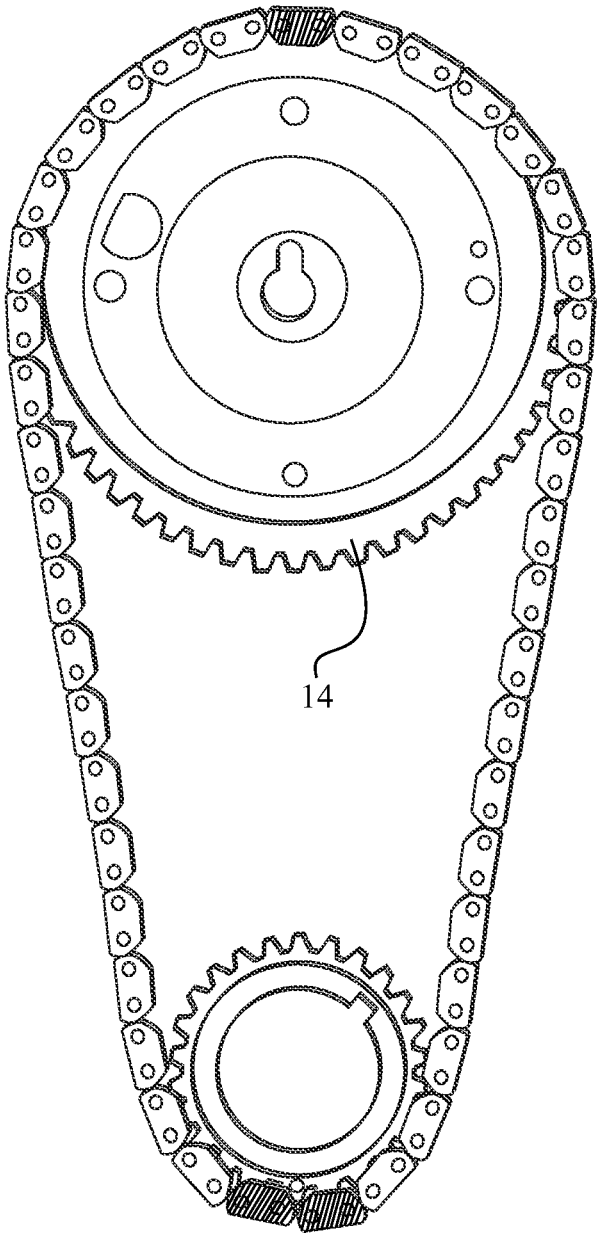
FIG. 7 is illustrating the correct timing for a crank sprocket, the cam position reluctor, and a timing chain in the present invention.

Then threaded cavities of the crankshaft, where the plurality of toothwheel bolts are screwed, are cleaned with break cleaner or equivalent solution and the plurality of toothwheel bolts is applied with strong threadlocker. In reference to FIG. 5, the crank position reluctor 15 is then positioned with the crankshaft, and the plurality of toothwheel bolts is traversed into the threaded cavities so that the crank position reluctor 15 can be securely attached to the crankshaft. A 110-120 inch-pound calibrated torque wrench is used to fasten the plurality of toothwheel bolts. The crank position reluctor 15 comprises a serious of square-edged teeth around its periphery where specific tooth spacing is engineered to provide a means to determine when one complete revolution has occurred. The crank position reluctor 15 in the present invention is configured uniquely for different engines so that the present can be integrated with variety of different engines. Once the crank position reluctor 15 is attached to the crankshaft, the crankshaft is reinstalled into the engine block along with the rod caps. Then the cam sprocket is removed from the camshaft and the cam position reluctor 14 is attached to the camshaft. The timing chain is reattached around the cam position reluctor 14 and the crank sprocket. In reference to FIG. 7, then the crank sprocket, the cam position reluctor 14, and the timing chain are adjusted according to the correct timing. When the crank sprocket, the cam position reluctor 14, and the timing chain are adjusted according to the correct timing, the keyway of the crank sprocket is in the 2-oclock position which puts a crank sprocket dot in the 6-oclock position, a dot of the cam position reluctor 14 is in the 12-oclock position, two colored links on the timing chain straddle the crank sprocket dot, and a single colored link on the timing chain on top of the dot of the cam position reluctor 14. After the correct timing is attained, the oil pan and the timing cover are reinstalled to the engine block.

If the hemispherical internal combustion engine is equipped with cylinder deactivation solenoids, the cylinder deactivation solenoids are removed from the engine block. The plurality of blockoff plugs 10 are then inserted into the engine block to obstruct the cavities exposed from the removal of the cylinder deactivation solenoids.

Figure 6:
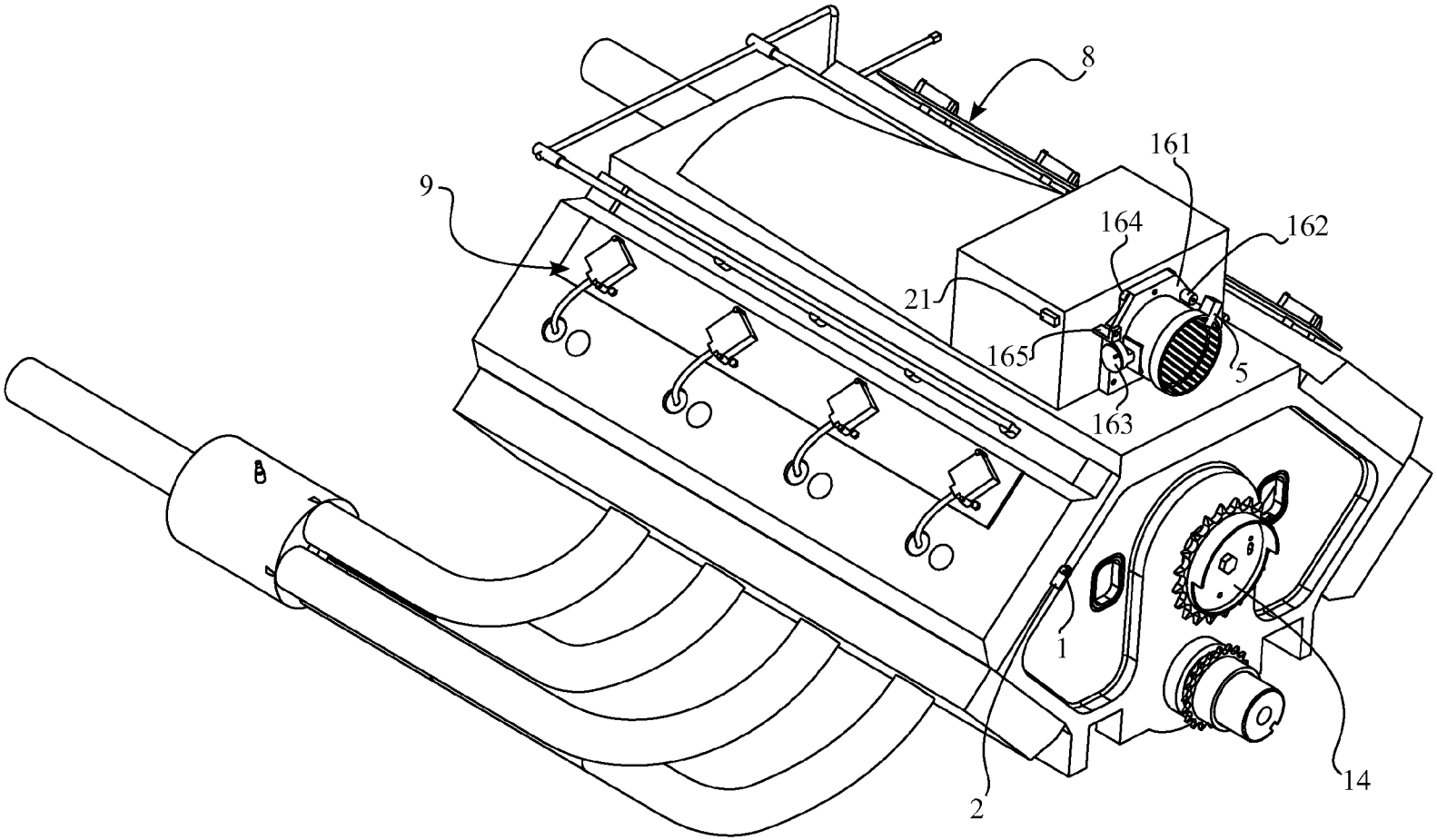
FIG. 6 is a front perspective view of an engine illustrating the location of some of the components in the present invention.
Figure 11:
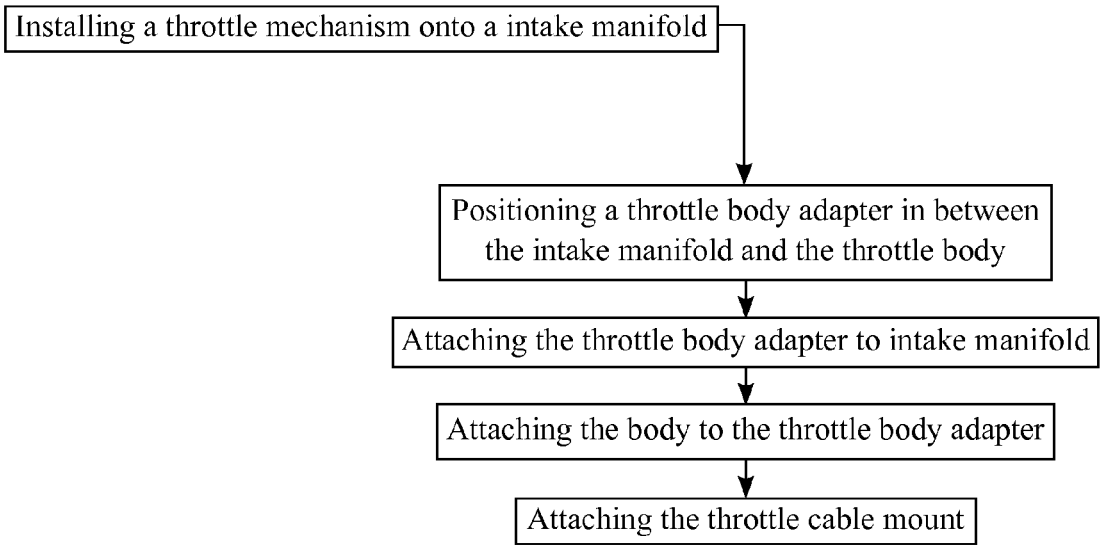
FIG. 11 is a simplified flow chart illustrating the method of installing a throttle mechanism.

In reference to FIG. 6 and FIG. 11, the throttle mechanism 16 is then installed to the intake manifold where the throttle mechanism 16 comprises a throttle body 161, a throttle body adapter 164, a throttle cable mount 165, a throttle position sensor (TPS) 162, an idle air control (IAC) valve 163, throttle body bolts 20, and throttle adapter bolts 22. The throttle body adapter 164 is positioned in between the intake manifold and the throttle body 161, and the throttle body adapter 164 is secured to the intake manifold by the throttle adapter bolts 22. Then the throttle body 161 is attached to the throttle body adapter 164 by the throttle body bolts 20, where an existing throttle gasket is used in between the throttle body adapter 164 and the throttle body 161. Then the throttle cable mount 165 is adjacently attached with the throttle body 161.

Figure 12:
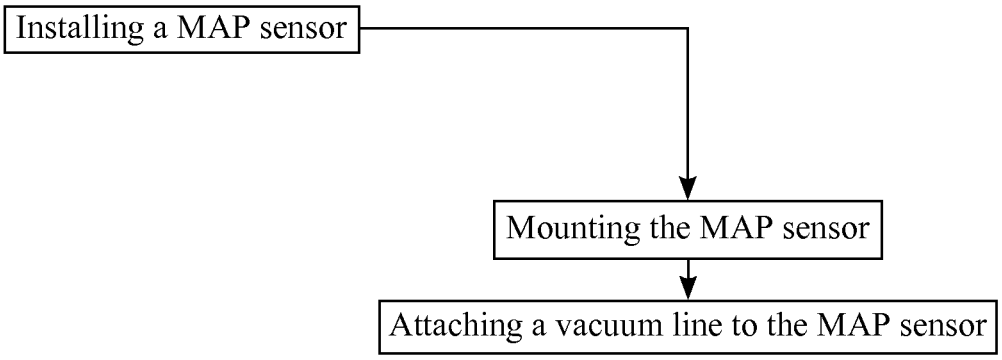
FIG. 12 is a simplified flow chart illustrating the method of installing a manifold absolute pressure sensor.

In reference to FIG. 12, the MAP sensor 21 provides instantaneous manifold pressure information to the ECU 13 so that the manifold pressure information can be used to calculate air density and determined the engine's air mass flow rate. The MAP sensor 21 of the present invention is attached adjacent to the intake manifold where the positioning of the MAP sensor 21 is chosen by the individual so that the MAP sensor 21 can be easily accessed for further connections. Then a vacuum line is attached to the MAP sensor 21 where the vacuum line is an unused port from the intake manifold.

The coolant temperature sensor 6, which measures the coolant temperature of the hemispherical internal combustion engine, is installed into a factory temperature sensor location on the engine block. The factory temperature sensor location can be easily identified as the factory temperature sensor location usually locates adjacent to a water pump of the engine block.

The first coil pack 8 and the second coil pack 9 in the present invention are installed in order to transform the battery's low voltage into higher volts so that the plurality of spark plugs can ignite within the fuel in combustion chambers of the engine block.

Figure 3:
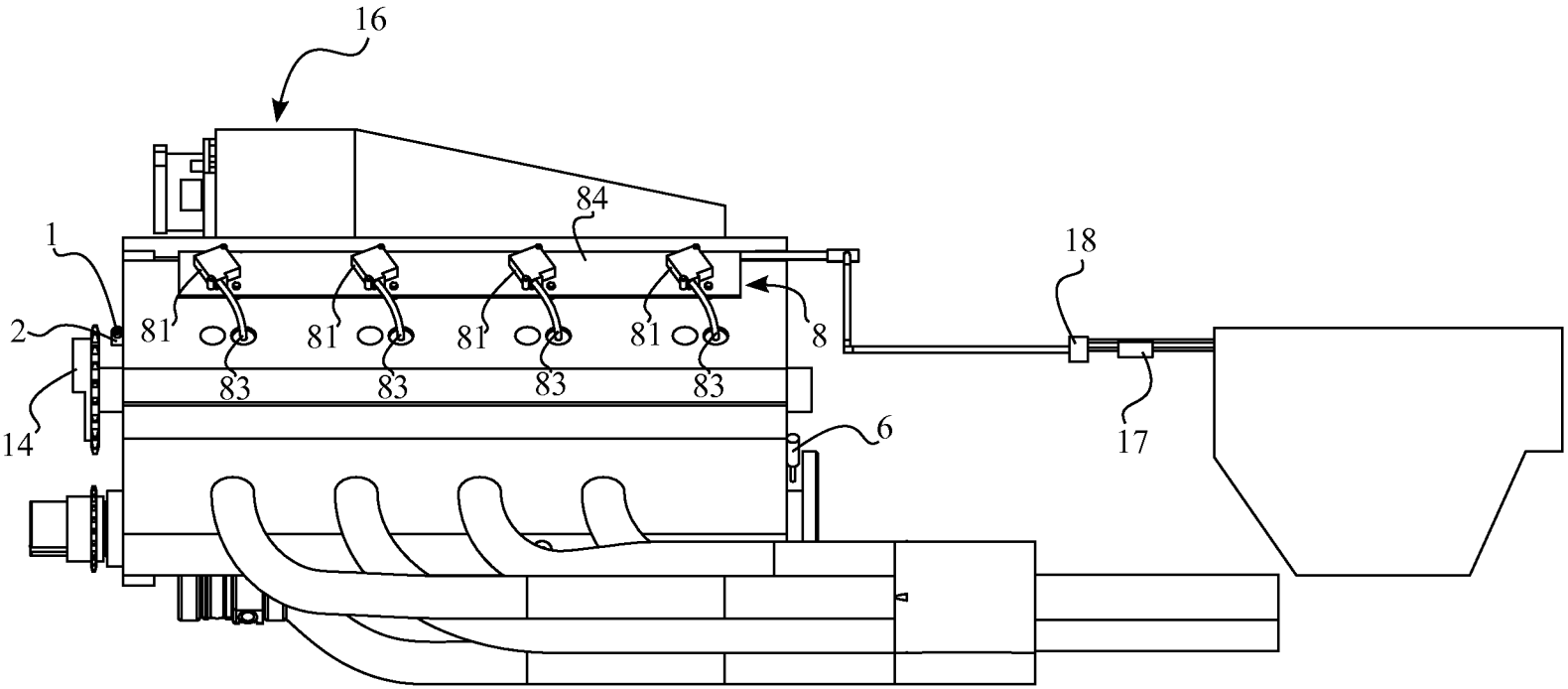
FIG. 3 is a side view of the engine illustrating the location of some of the components in the present invention.
Figure 13:
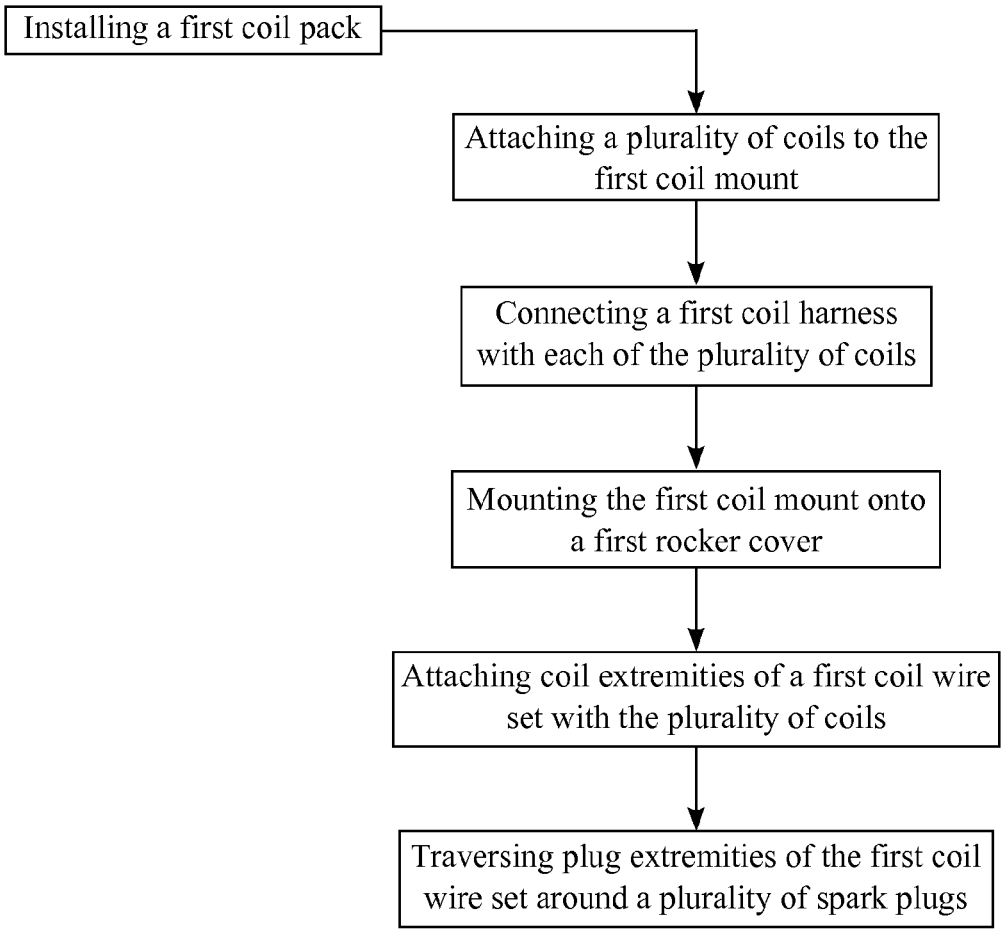
FIG. 13 is a simplified flow chart illustrating the method of installing a first coil pack.

In reference to FIG. 3 and FIG. 13, the first coil pack 8 is installed onto a first rocker cover of the rocker covers where the first coil pack 8 comprises a plurality of coils 81, a first coil harness 82, a first coil wire set 83, a plurality of coil nuts and bolts 23, coil mount bolts 24, and a first coil mount 84. As for the first coil pack 8, the plurality of coils 81 is attached to the first coil mount 84 by the plurality of coil nuts and bolts 23. Then the first coil harness 82 is jointly attached with each of the plurality of coils 81, and the first coil mount 84 is mounted onto the first rocker cover by the coil mount bolts 24. Coil extremities of the first coil wire set 83 are attached with the plurality of coils 81, and plug extremities of the first coil wire set 83 are traversed around the plurality of spark plugs according to the correct firing order.

Figure 4:
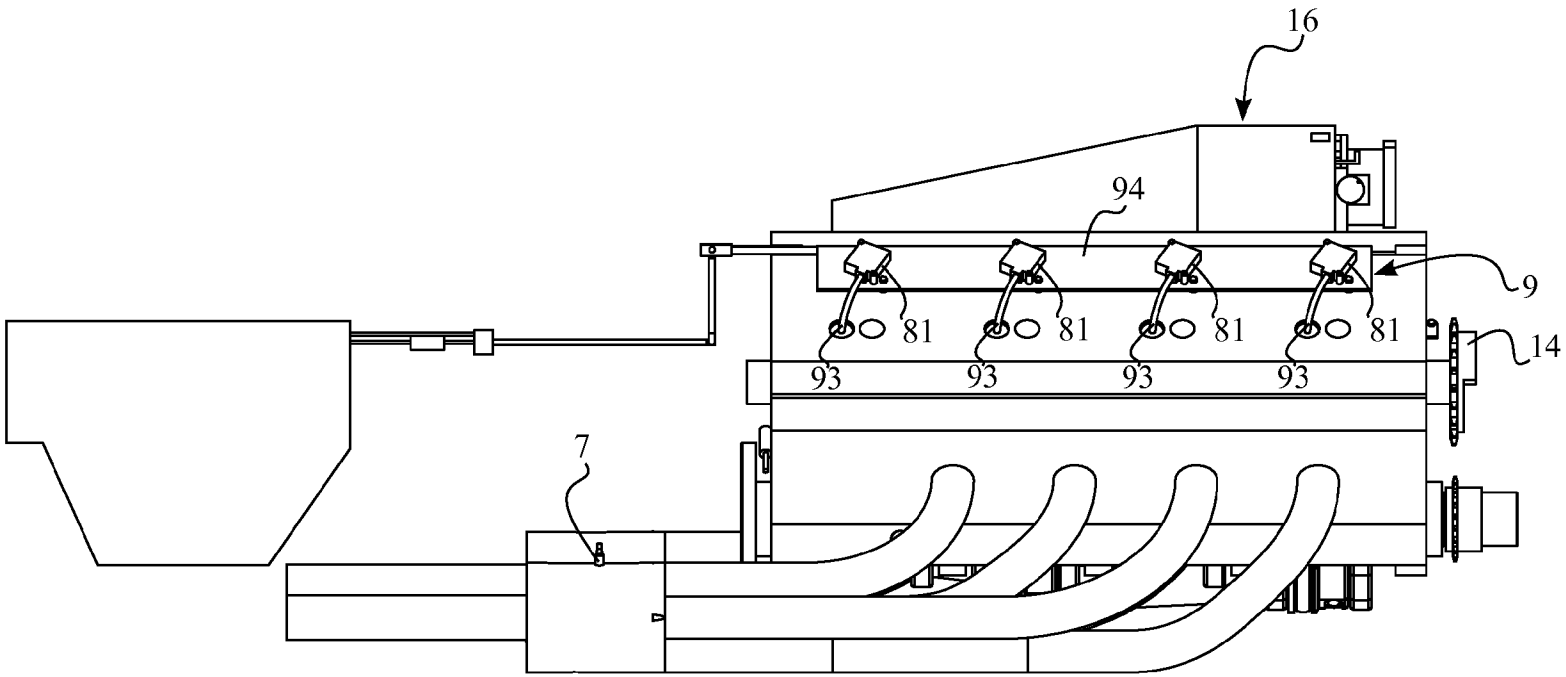
FIG. 4 is an opposite side view of the engine illustrating the location of some of the components in the present invention.
Figure 14:
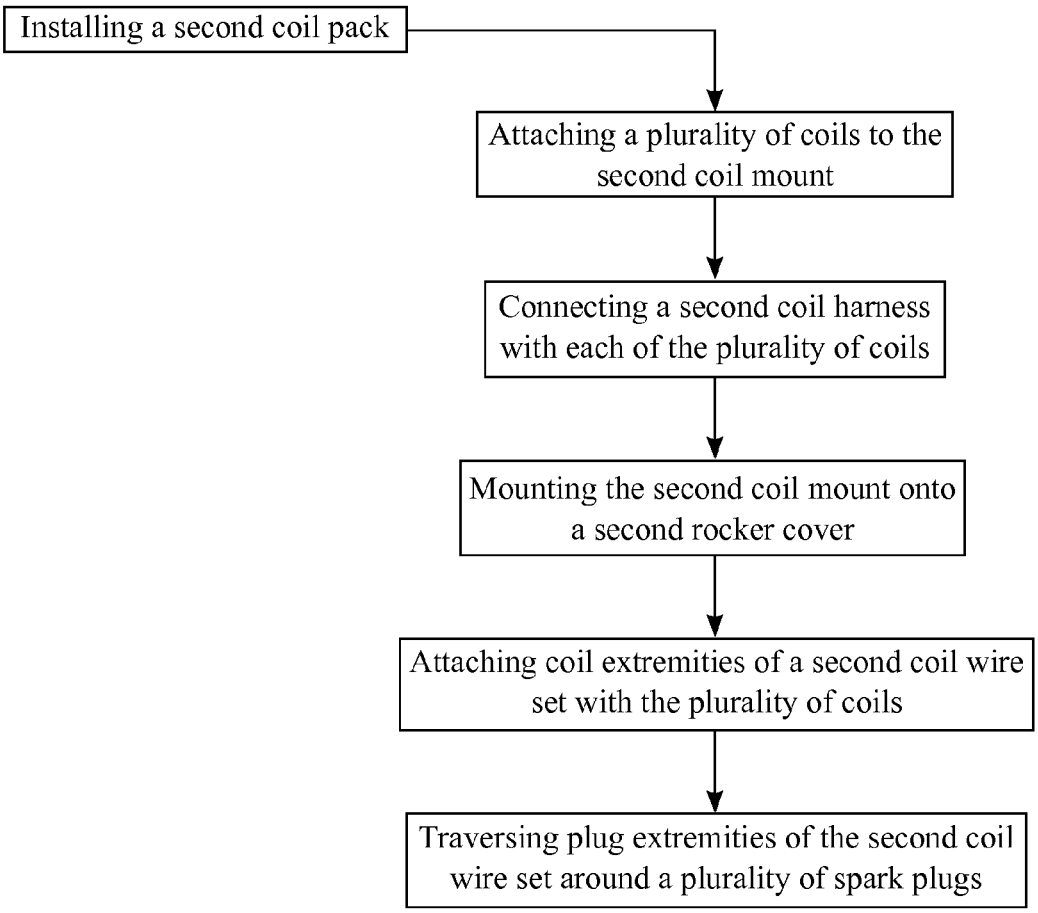
FIG. 14 is a simplified flow chart illustrating the method of installing a second coil pack.

In reference to FIG. 4 and FIG. 14, the second coil pack 9 is installed onto a second rocker cover of the rocker covers where the second coil pack 9 comprises the plurality of coils 81, a second coil harness 92, a second coil wire set 93, the plurality of coil nuts and bolts 23, the coil mount bolts 24, and a second coil mount 94. As for the second coil pack 9, the plurality of coils 81 is attached to the second coil mount 94 by the plurality of coil nuts and bolts 23. Then the second coil harness 92 is jointly attached with each of the plurality of coils 81, and the second coil mount 94 is mounted onto the second rocker cover by the coil mount bolts 24. Coil extremities of the second coil wire set 93 are attached with the plurality of coils 81, and plug extremities of the second coil wire set 93 are traversed around the plurality of spark plugs according to the correct firing order.

Figure 15:
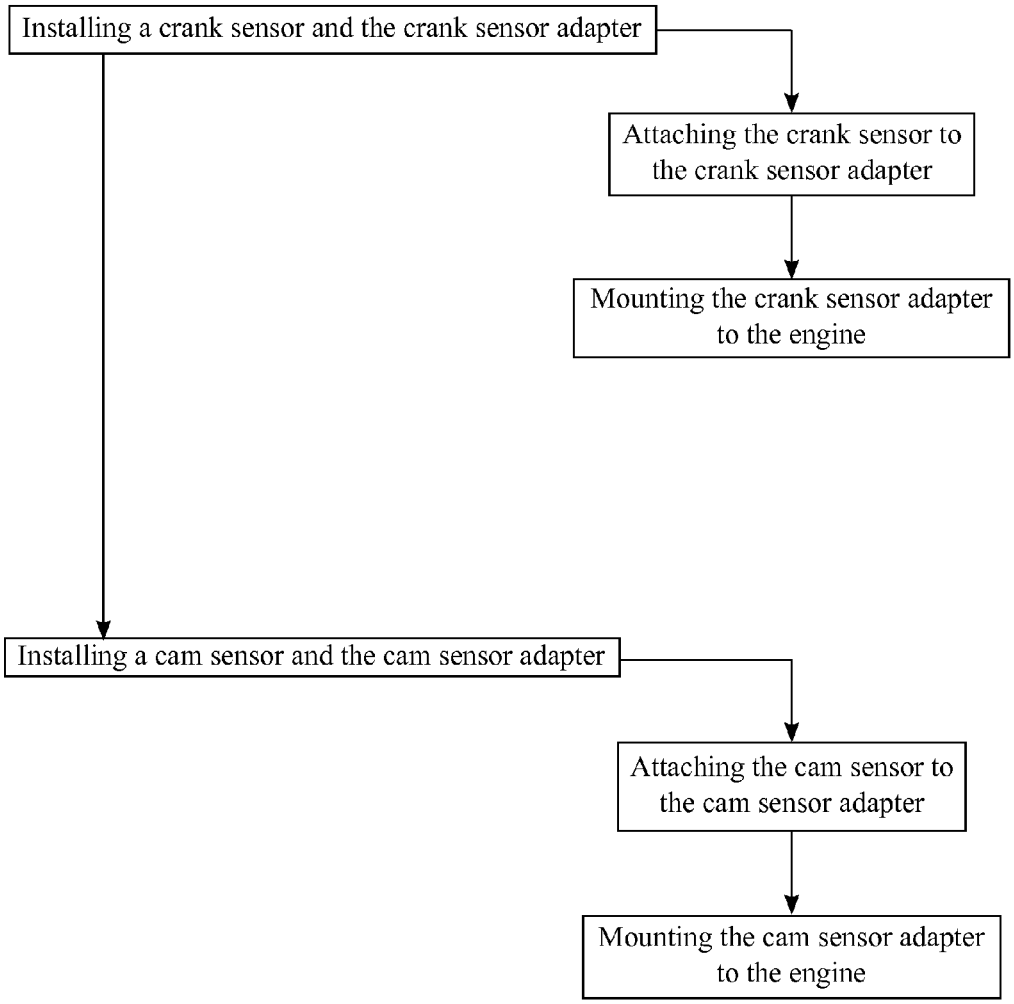
FIG. 15 is a simplified flow chart illustrating the method of installing a crank sensor and a cam sensor.

The crank sensor 3 is an electronic device that monitors the position or rotational speed of the crankshaft. In reference to FIG. 5 and FIG. 15, the crank sensor 3 of the present invention is attached to the crank sensor adapter bracket 31, and the crank sensor adapter bracket 31 is attached onto the engine block by a sensor connecting bolt 25. The crank sensor 3 is closely positioned with the outside diameter of the serious of squared-edged teeth of the crank position reluctor 15, where the crank sensor 3 functions as a hall-effect sensor and sends out a pulse to the ECU 13 when tooth edge is passed by the crank sensor 3. The cam sensor 1 is an electronic device that determines the position of a camshaft in the engine block. In reference to FIG. 6 and FIG. 15, the cam sensor 1 of the present invention is attached to the cam sensor adapter bracket 2, and the cam sensor adapter bracket 2 is attached onto the engine block by the sensor connecting bolt 25. The cam sensor 1 is closely positioned with the outside teeth diameter of the cam position reluctor 14, where the cam sensor 1 functions as a hall-effect sensor and sends out a pulse to the ECU 13 when tooth edge is passed by the cam sensor 1. The pair of knock sensors 4 is an electronic device that allows the hemispherical internal combustion engine to run with optimum ignition timing and protects the hemispherical internal combustion engine against power-rubbing and engine knocking. The pair of knock sensors 4 in the present invention is attached into water drains of the engine block. In order to properly install the pair of knock sensors 4, the engine block may require some grinding around the water drains. Before installing the pair of knock sensors 4, the pair of knock sensors 4 needs to be applied with appropriate sealer for secure attachment, where the appropriate sealer is provided within the present invention. Additionally, the pair of knock sensors 4 should not be over tightened during the installation process since it can damage the pair of knock sensors 4.

Figure 16:
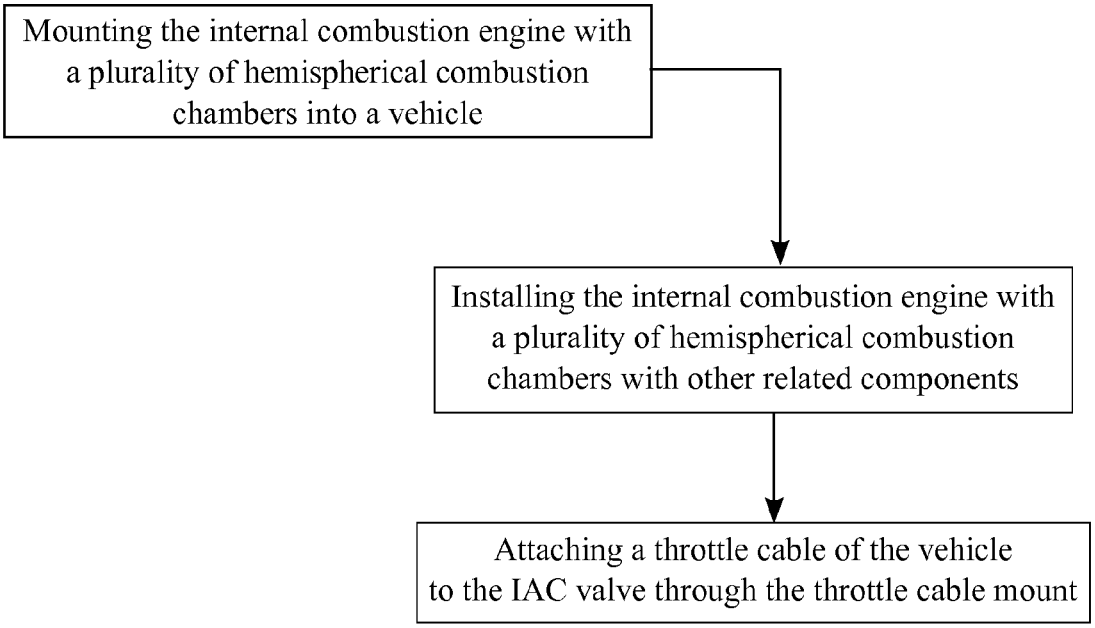
FIG. 16 is a simplified flow chart illustrating the method of installing the engine into a vehicle.

Then the hemispherical internal combustion engine is installed into a vehicle along with other related components, where the other related components enable the hemispherical internal combustion engine to properly function with the vehicle. In reference to FIG. 16, if the vehicle is controlled by a cable throttle system, an extended throttle cable is positioned through the throttle cable mount 165 and attached to the IAC valve 163 so that the IAC valve 163 can be controlled.

The ECU 13 is an electronic control unit that controls a series of actuators on an internal combustion engine to ensure the optimum running condition. When the ECU 13 retrieves data from connected components and the sensors, the data is interpreted and the series of actuators are adjusted according to the output. For example, the ECU 13 makes rapid calculations to determine the amount of fuel to be delivered to each cylinder for every combustion cycle and calculate the instantaneous timing of the ignition spark for every combustion event. The ECU 13 of the present invention is mounted adjacent with a dashboard of the vehicle. The ECU 13 is mounted adjacent with the dashboard so that the heat from the hemispherical internal combustion engine cannot damage the fragile electronic components of the ECU 13. The ECU 13 is electrically connected with the required connections of the vehicle so that the ECU 13 is able to accurately function within the vehicle. The main harness 11 of the present invention is electrically pre-connected with the ECU 13 providing a simplified installation process.

Figure 8:
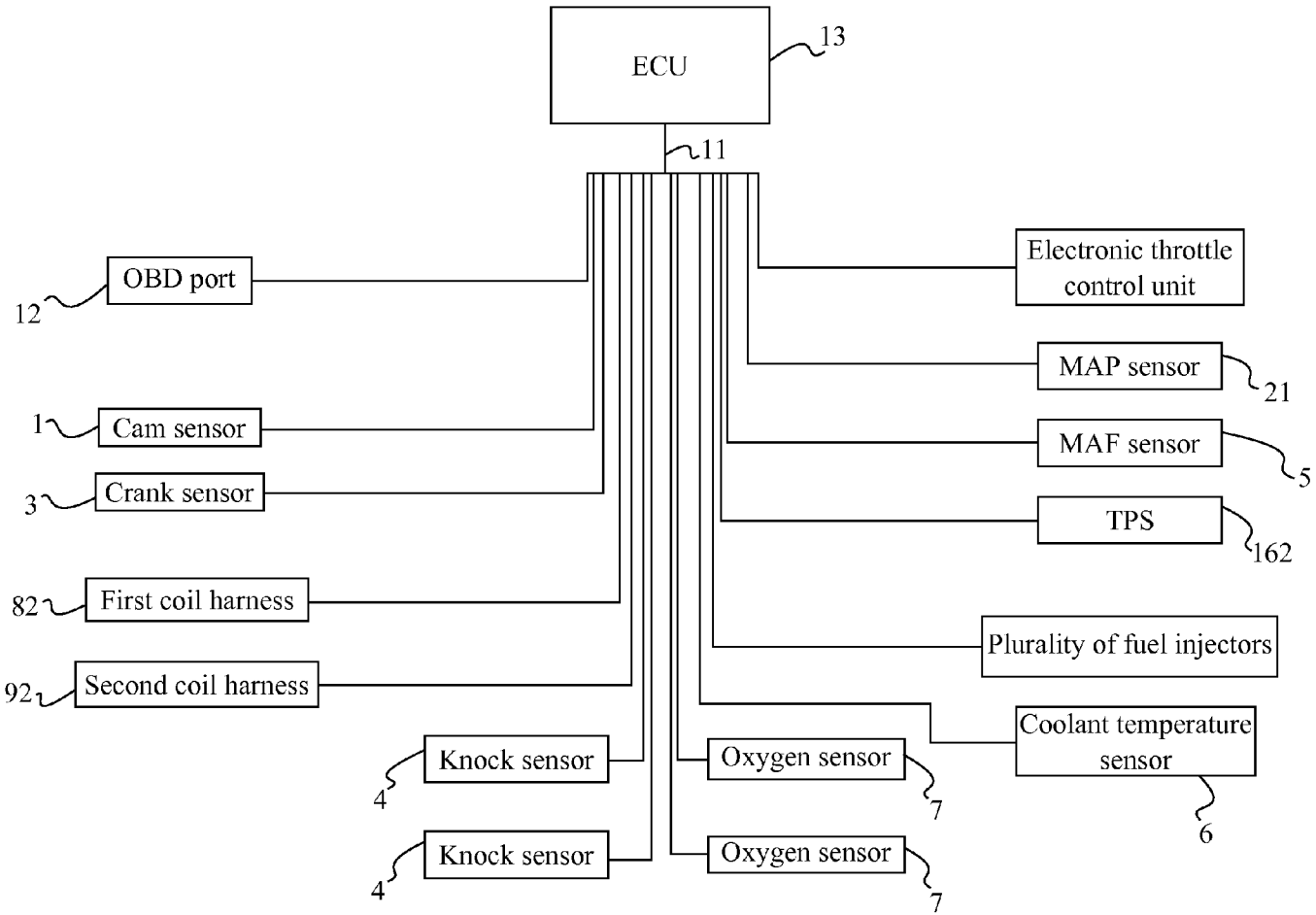
FIG. 8 is a view of an electrical schematic of the present invention.
Figure 9:
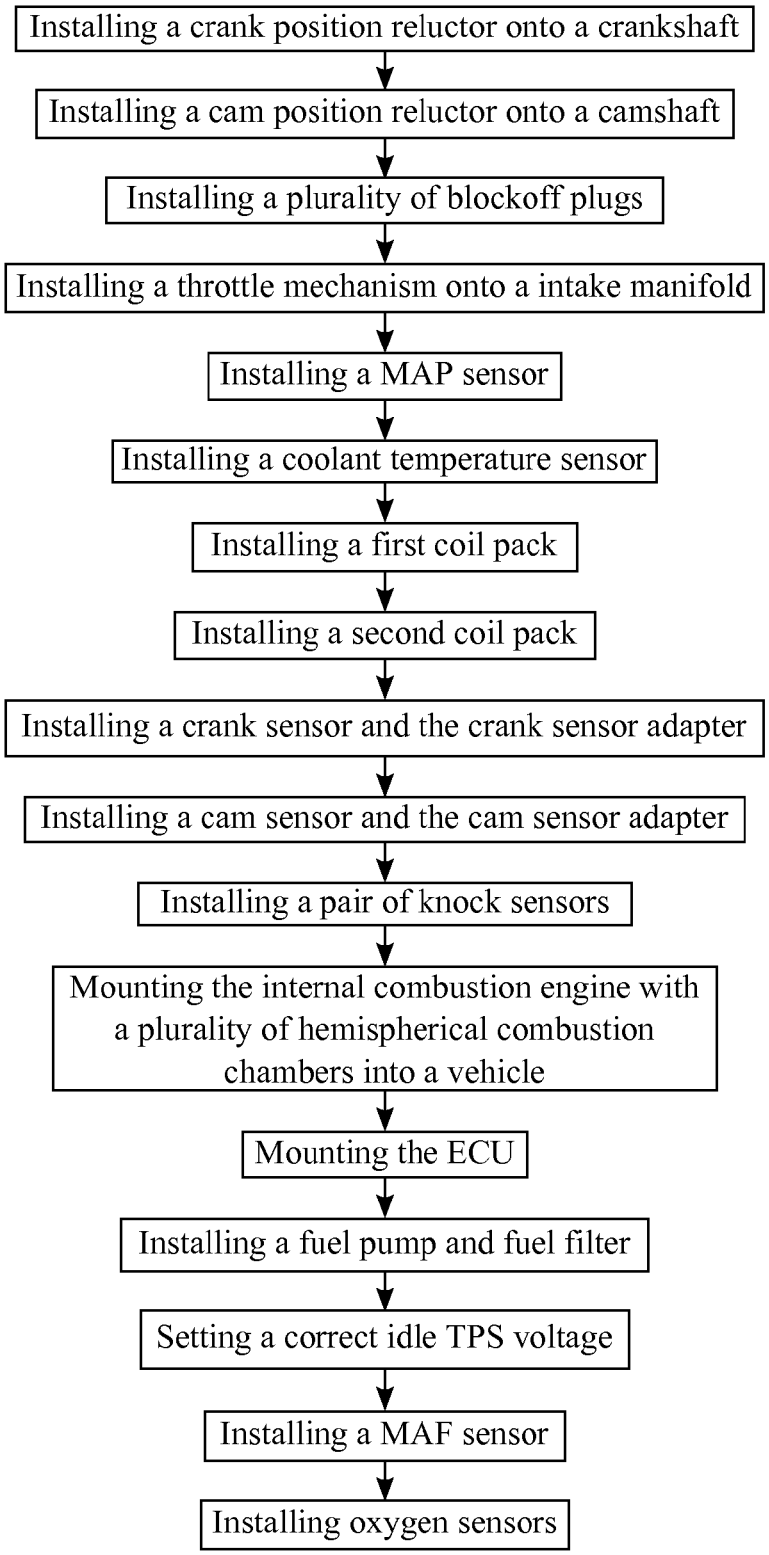
FIG. 9 is a simplified flow chart illustrating the overall method of installing the present invention.

In reference to FIG. 8, the main harness 11 comprises a cam sensor port, a manifold sensor port, a crank sensor port, knock sensor ports, a mass airflow sensor port, a temperature port, oxygen sensor ports, a first coil pack port, a second coil pack port, a plurality of injector ports, an on-board diagnostic (OBD) port 12, a throttle position port, and a throttle control port. The cam sensor port is electrically connected with the cam sensor 1 where the connection enables the ECU 13 retrieve data about the positioning of the camshaft. The manifold sensor port is electrically connected with the MAP sensor 21 which provides the instantaneous manifold pressure information to the ECU 13 so that the manifold pressure information can be used to calculate air density and determined the air mass flow rate of the hemispherical internal combustion engine. The crank sensor port is electrically connected with the crank sensor 3 enabling the ECU 13 to retrieve data about the rotational speed of the crankshaft. The knock sensor ports are electrically connected with the pair of knock sensors 4 which allow the ECU 13 to detect any problems regarding the hemispherical internal combustion engine. The temperature port is electrically connected with the coolant temperature sensor 6 where the ECU 13 is able to retrieve the coolant temperature of the hemispherical internal combustion engine at any given time. The first coil pack port is electrically connected with the first coil harness 82, and the second coil pack port is electrically connected with the second coil harness 92. The plurality of injector ports is electrically connected to with the plurality of fuel injectors. The plurality of injector ports and the ECU 13 also compatible with aftermarket fuel injectors for highly modified hemispherical internal combustion engines. The throttle position port is electrically connected with the TPS 162 where the ECU 13 can monitor the positioning of a throttle in the throttle body 161. The throttle control port is electrically connected with an electronic throttle control unit in order to operate the IAC valve 163. The throttle control port is only functional if the vehicle doesn't comprise the cable throttle system and equipped with the electronic throttle control unit.

The OBD port 12 is also mounted adjacent to the dashboard and away from the engine block, where the OBD port 12 is easily accessible so that technicians can easily retrieve diagnostic information regarding malfunctions within the vehicle. Since the OBD port 12 is electrically pre-connected with the ECU 13, the technicians receive the diagnostic information regarding the malfunctions from the ECU 13.

Figure 5:
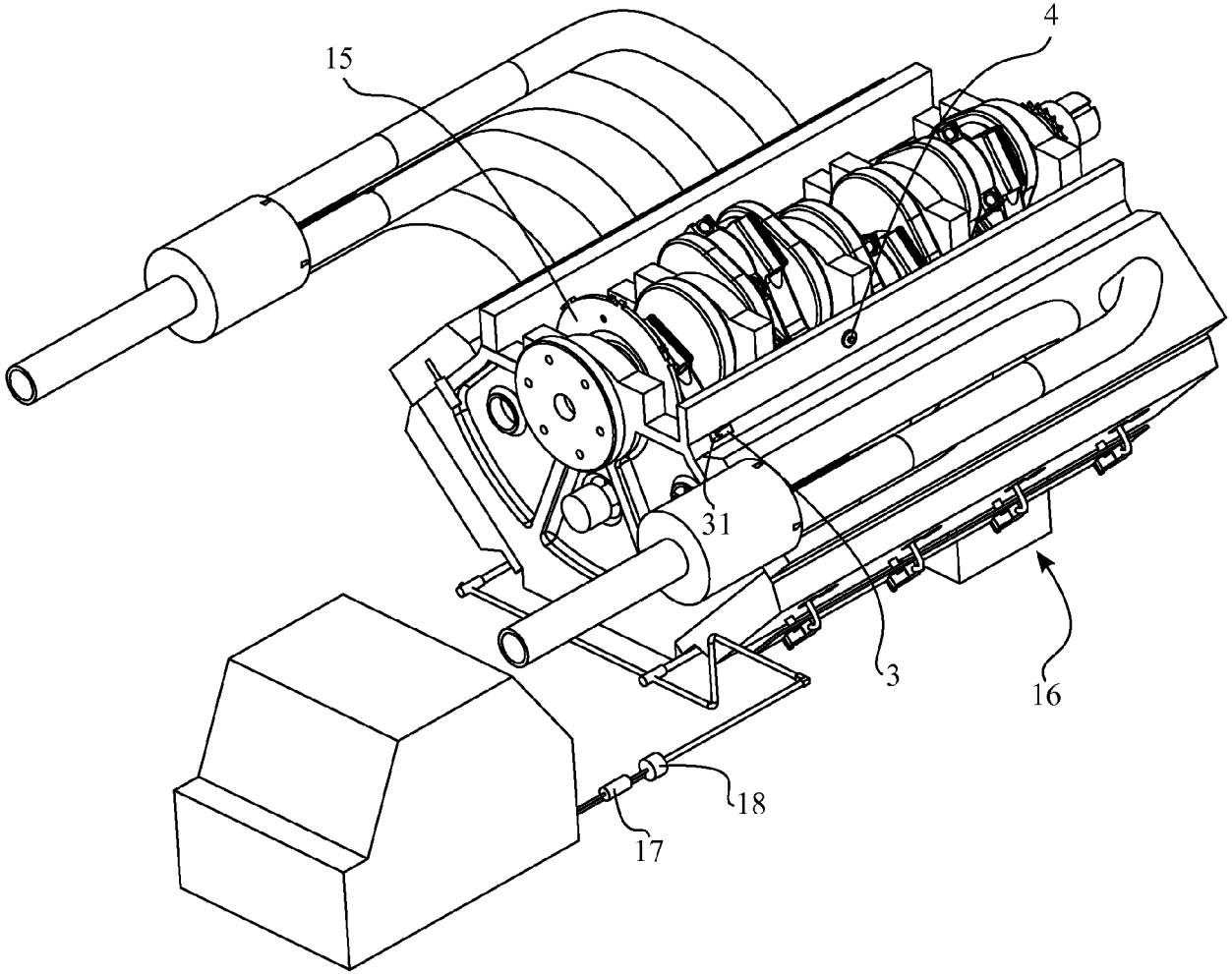
FIG. 5 is a bottom perspective view of an engine illustrating the location of some of the components in the present invention.
Figure 17:
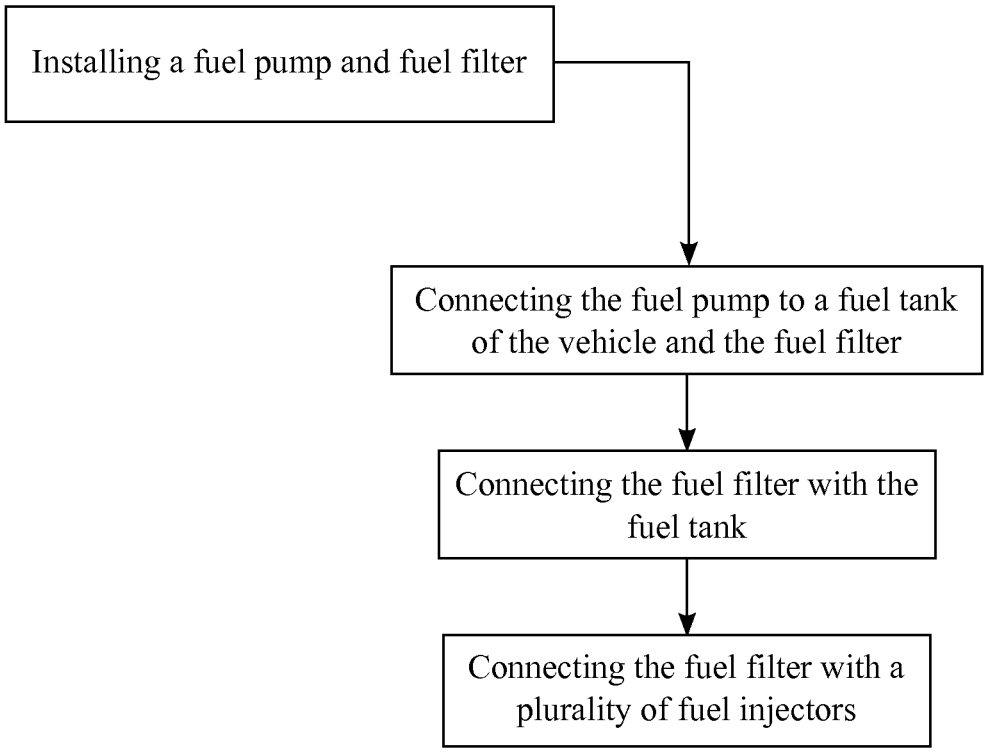
FIG. 17 is a simplified flow chart illustrating the method of installing a fuel pump and the fuel filter.

In reference to FIG. 5 and FIG. 17, the fuel pump 17 and the fuel filter 18 of the present invention function similar to the ordinary fuel pumps and fuel filters of the vehicle, but the fuel filter 18 of the present invention has a built in pressure regulator. The fuel pump 17 is positioned in between a fuel tank of the vehicle and the fuel filter 18. Each extremity of the fuel pump 17 is connected with the fuel tank and the fuel filter 18 by an injection rated fuel line. The fuel filter 18 future comprises a male fitting outlet and a female fitting outlet. The male fitting outlet of the fuel filter 18 is connected with the fuel tank by the injection rated fuel line, and the female fitting outlet of the fuel filter 18 is connected with each of the plurality of fuel injectors in the intake manifold by the injection rated fuel line.

Figure 18:
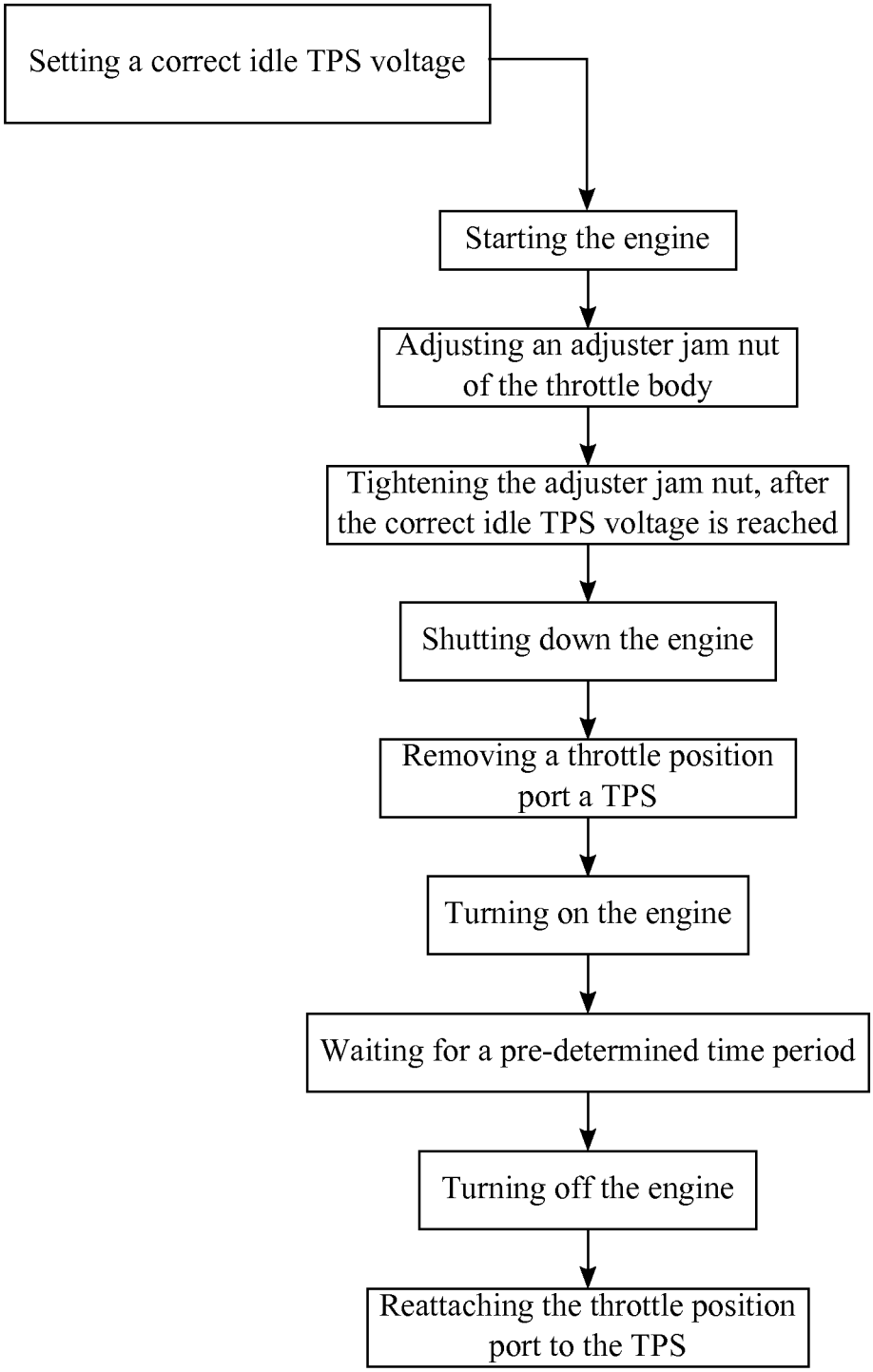
FIG. 18 is a simplified flow chart illustrating the method of setting a correct idle TPS voltage.

Then the individual needs to set a correct idle TPS voltage for the TPS 162 so that correct startup and idle, as well as smooth throttle response can be obtained. In reference to FIG. 18, as the initial step to set the correct idle TPS voltage, the hemispherical internal combustion engine is started by the individual. Then an adjuster jam nut of the throttle body 161 is adjusted until the correct idle TPS voltage is reached, where the correct idle TPS voltage is obtained from the throttle position port and displayed through an electronic measuring instrument. Then the adjuster jam nut is tightened so that the correct idle TPS voltage can be saved within the throttle body 161. Then the hemispherical internal combustion engine is shut down, and the throttle position port is removed from the TPS 162. Then the hemispherical internal combustion engine is turned on and kept turned on for a pre-determined time period. As the final steps of the setting the correct idle TPS voltage, the hemispherical internal combustion engine is then turned off, and the throttle position port is reattached with the TPS 162.

After the correct idle TPS voltage is attained, the MAF sensor 5 is installed onto the cold air intake and the airbox of the vehicle, where the airbox houses the air filter. The mass airflow sensor port is electrically connected with the MAF sensor 5. The MAF sensor 5 in the present invention is an electronic device which measures the mass flow rate of air entering into the hemispherical internal combustion engine so that the ECU 13 can deliver the correct fuel mass to the hemispherical internal combustion engine.

The oxygen sensors 7 in the present invention are electronic devices that measure the richness and the leanness of the air fuel ratio. Each of the oxygen sensors 7 is installed into a collector of each of the exhaust headers, and the oxygen sensor ports are electrically connected with each of the oxygen sensors 7. Because of the oxygen sensors 7 and the ECU 13 are electrically connected from the oxygen sensor port, the ECU 13 obtained the measured richness or leanness of the oxygen sensors 7 from the collector of each of the exhaust headers.

The present invention may include a plurality of transmission adapters so that other electronic transmissions can replace the existing transmission. The plurality of transmission adapters makes the hemispherical internal combustion engine compatible with the other electronic transmissions. The other electronic transmission contains its own dedicated transmission control module (TCM). The present invention's adaptation of the ECU 13 to the hemispherical internal combustion engine allows the ECU 13 to control other electronic transmission by communicating directly with the TCM.

Although the invention has been explained in relation to its preferred embodiment, it is to be understood that many other possible modifications and variations can be made without departing from the spirit and scope of the invention as hereinafter claimed.

What is claimed is:

1. A method of installing a flexible computer control for an internal combustion engine with a plurality of hemispherical combustion chambers comprises the steps of:

providing an internal combustion engine with a plurality of hemispherical combustion chambers, wherein the combustion engine with a plurality of hemispherical combustion chambers comprises a crankshaft, a camshaft, a cam sprocket, a crank sprocket, a timing chain, an intake manifold, an engine block, rocker covers, a cold air intake, a plurality of fuel injectors, a plurality of spark plugs, and exhaust headers;

providing an engine control unit (ECU), a crank position reluctor, a cam position reluctor, a plurality of blockoff plugs, a throttle mechanism, a manifold absolute pressure (MAP) sensor, a coolant temperature sensor, a first coil pack, a second coil pack, a crank sensor, a crank sensor adapter bracket, a pair of knock sensors, a cam sensor, a cam sensor adapter bracket, a fuel pump, a fuel filter, a mass airflow (MAF) sensor, and oxygen sensors;

providing a main harness, wherein the main harness comprises a cam sensor port, a manifold sensor port, a crank sensor port, knock sensor ports, a mass airflow sensor port, a temperature port, oxygen sensor ports, a first coil pack port, a second coil pack port, a plurality of injector ports, an on-board diagnostic (OBD) port, a throttle position port, and a throttle control port;

installing the crank position reluctor onto the crankshaft;

installing the cam position reluctor onto the camshaft;

installing the plurality of blockoff plugs into cylinder deactivation holes of the engine block, wherein the cylinder deactivation holes are created by the removal of existing cylinder deactivation solenoids;

installing the throttle mechanism onto the intake manifold, wherein the throttle mechanism comprises a throttle body, a throttle body adapter, a throttle cable mount, a throttle position sensor (TPS), an idle air control (IAC) valve, throttle body bolts, and throttle adapter bolts;

installing the MAP sensor on the intake manifold;

installing the coolant temperature sensor into a factory temperature sensor location on the engine block, wherein the factory temperature sensor location is adjacently positioned with a water pump of the engine block;

installing the first coil pack onto the rocker covers, wherein the first coil pack comprises a plurality of coils, a first coil harness, a first coil wire set, a plurality of coil nuts and bolts, coil mount bolts, and a first coil mount;

installing the second coil pack onto the rocker covers, wherein the second coil pack comprises a plurality of coils, a second coil harness, a second coil wire set, a plurality of coil nuts and bolts, coil mount bolts, and a second coil mount;

installing the crank sensor and the crank sensor adapter onto the engine block;

installing the cam sensor and the cam sensor adapter onto the engine block;

installing the pair of knock sensors into water drains of the engine block;

mounting the internal combustion engine with a plurality of hemispherical combustion chambers into a vehicle;

mounting the ECU adjacent with a dashboard of the vehicle, wherein the ECU is electrically pre-connected with the main harness;

installing the fuel pump and the fuel filter;

setting a correct idle TPS voltage for the TPS;

installing the MAF sensor onto the cold air intake and an airbox of the vehicle, wherein the airbox houses a air filter; and installing each of the oxygen sensors into a collector of each of the exhaust headers.

2. The method of installing a flexible computer control for an internal combustion engine with a plurality of hemispherical combustion chambers as claimed in claim 1 comprises the steps of:

removing an oil pan and a timing chain cover of the engine block;

turning the crankshaft in order to orient correct timing for the crank sprocket, the cam sprocket, and the timing chain;

removing the timing chain and rod caps, wherein the rod caps are positioned around the crankshaft;

removing the crankshaft from the engine block;

removing an original crank reluctor from the crankshaft;

attaching the crank position reluctor to the crankshaft, wherein the crank position reluctor replaces the original crank reluctor;

respectively reinstalling the crankshaft and the rod caps to the engine block;

removing the cam sprocket from the camshaft;

attaching the cam position reluctor onto the camshaft;

placing the timing chain around the crank sprocket and the cam position reluctor;

aligning the crank sprocket, the cam position reluctor, and the timing chain according to the correct timing; and reinstalling the oil pan and the timing cover.

3. The method of installing a flexible computer control for an internal combustion engine with a plurality of hemispherical combustion chambers as claimed in claim 1 comprises the steps of:

positioning the throttle body adapter in between the intake manifold and the throttle body;

attaching the throttle body adapter to the intake manifold by the throttle adapter bolts;

attaching the throttle body to the throttle body adapter by the throttle body bolts; and attaching the throttle cable mount adjacent with the throttle body.

4. The method of installing a flexible computer control for an internal combustion engine with a plurality of hemispherical combustion chambers as claimed in claim 1 comprises the steps of:

mounting the MAP sensor adjacent to the intake manifold; and attaching a vacuum line to the MAP sensor, wherein the vacuum line is an unused port from the intake manifold.

5. The method of installing a flexible computer control for an internal combustion engine with a plurality of hemispherical combustion chambers as claimed in claim 1 comprises the steps of:

attaching the plurality of coils to the first coil mount by the plurality of coil nuts and bolts;

jointly connecting the first coil harness with each of the plurality of coils;

mounting the first coil mount onto a first rocker cover of the rocker covers by the coil mount bolts;

attaching coil extremities of the first coil wire set with the plurality of coils; and traversing plug extremities of the first coil wire set around the plurality of spark plugs.

6. The method of installing a flexible computer control for an internal combustion engine with a plurality of hemispherical combustion chambers as claimed in claim 1 comprises the steps of:

attaching the plurality of coils to the second coil mount by the plurality of coil nuts and bolts;

jointly connecting the second coil harness with each of the plurality of coils;

mounting the second coil mount onto a second rocker cover of the rocker covers by the coil mount bolts;

connecting coil extremities of the second coil wire set with the plurality of coils; and traversing plug extremities of the second coil wire set around the plurality of spark plugs.

7. The method of installing a flexible computer control for an internal combustion engine with a plurality of hemispherical combustion chambers as claimed in claim 1 comprises the steps of:

attaching the crank sensor to the crank sensor adapter bracket;

mounting the crank sensor adapter bracket onto the engine block;

attaching the cam sensor to the cam sensor adapter bracket; and mounting the cam sensor adapter bracket onto the engine block.

8. The method of installing a flexible computer control for an internal combustion engine with a plurality of hemispherical combustion chambers as claimed in claim 1 comprises the steps of:

installing the internal combustion engine with a plurality of hemispherical combustion chambers with other related components, wherein the other related components enable the internal combustion engine with a plurality of hemispherical combustion chambers to fully function within the vehicle; and attaching an extended throttle cable of the vehicle to the IAC valve through the throttle cable mount, if the IAC valve is controlled by a cable throttle system.

9. The method of installing a flexible computer control for an internal combustion engine with a plurality of hemispherical combustion chambers as claimed in claim 1 comprises the steps of:

electrically connecting the ECU with required connections of the vehicle, wherein the required connections provide accurate functionality of the ECU;

mounting the OBD port adjacent to the dashboard of the vehicle and away from the engine block;

electrically connecting the cam sensor port with the cam sensor;

electrically connecting the manifold sensor port with the MAP;

electrically connecting the crank sensor port with the crank sensor;

electrically connecting the knock sensor ports with the pair of knock sensors;

electrically connecting the temperature port with the coolant temperature sensor;

electrically connecting the first coil pack port with the first coil harness;

electrically connecting the second coil pack port with the second coil harness;

electrically connecting the plurality of injector ports with the plurality of fuel injectors;

electrically connecting the throttle position port with the TPS; and electrically connecting the throttle control port with an electronic throttle control unit in order to operate the IAC valve, if the vehicle don't comprise a cable throttle system and equipped the electronic throttle control unit.

10. The method of installing a flexible computer control for an internal combustion engine with a plurality of hemispherical combustion chambers as claimed in claim 1 comprises the steps of:

connecting each extremity of the fuel pump to a fuel tank of the vehicle and the fuel filter by an injection rated fuel line;

connecting a male fitting outlet of the fuel filter with the fuel tank by the injection rated fuel line; and connecting a female fitting outlet of the fuel filter with the plurality of fuel injectors by the injection rated fuel line, wherein the plurality of fuel injectors is positioned on the intake manifold.

11. The method of installing a flexible computer control for an internal combustion engine with a plurality of hemispherical combustion chambers as claimed in claim 1 comprises the steps of:

starting the internal combustion engine with a plurality of hemispherical combustion chambers;

adjusting an adjuster jam nut of the throttle body until the correct idle TPS voltage is reached, wherein the correct idle TPS voltage is obtained from the throttle position port and displayed through an electronic measuring instrument;

tightening the adjuster jam nut, after the correct idle TPS voltage is reached;

shutting down the internal combustion engine with a plurality of hemispherical combustion chambers;

removing the throttle position port from the TPS;

turning on the internal combustion engine with a plurality of hemispherical combustion chambers;

waiting for a pre-determined time period;

turning off the internal combustion engine with a plurality of hemispherical combustion chambers; and reattaching the throttle position port to the TPS.

12. The method of installing a flexible computer control for an internal combustion engine with a plurality of hemispherical combustion chambers as claimed in claim 1 comprises:

electrically connecting the mass airflow sensor port with the MAF sensor.

13. The method of installing a flexible computer control for an internal combustion engine with a plurality of hemispherical combustion chambers as claimed in claim 1 comprises:

electrically connecting each of the oxygen sensor ports with each of the oxygen sensors.

* * * * *